United States Patent [19]

Ohtsuki

[11] Patent Number: 4,484,872

[45] Date of Patent: Nov. 27, 1984

[54] GLOBOID-WORM MACHINE WITH TAPERED SCREW CLEARANCE NEAR HIGH PRESSURE END SEAL

[75] Inventor: Akira Ohtsuki, Nagaokakyo, Japan

[73] Assignee: Omphale S.A., Puteaux, France

[21] Appl. No.: 457,216

[22] Filed: Jan. 11, 1983

[30] Foreign Application Priority Data

Jan. 14, 1982 [FR] France ..... 82 00500

[51] Int. Cl.[3] ..... F01C 1/24; F04C 27/00

[52] U.S. Cl. ..... 418/140; 418/195

[58] Field of Search ..... 418/140–144, 418/195–197

[56] References Cited

U.S. PATENT DOCUMENTS

Re. 30,400 9/1980 Zimmern ..... 418/195
3,632,239 1/1972 Zimmern ..... 418/195

FOREIGN PATENT DOCUMENTS 518183 12/1920 France .
78706 11/1960 France .
1331998 5/1962 France .
1586832 2/1968 France .
1548390 8/1975 United Kingdom .
1555329 8/1975 United Kingdom .

*Primary Examiner*—Leonard E. Smith
*Assistant Examiner*—Jane E. Obee
*Attorney, Agent, or Firm*—Ziems, Walter & Shannon

[57] ABSTRACT

A volumetric machine comprises a screw rotatable inside a casing and cooperating with at least one pinion-wheel. The screw has a low pressure end adjacent a low pressure port and a high pressure end adjacent a high pressure port, the high pressure end being provided with an annular sealing device substantially preventing axial leakage towards a cavity maintained at the low pressure to reduce axial thrusts on the screw. The profile of the screw corresponds to that of the casing with a very small clearance, except in an area adjacent the sealing device where the clearance increases from the low pressure side towards the sealing device.

2 Claims, 4 Drawing Figures

GLOBOID-WORM MACHINE WITH TAPERED SCREW CLEARANCE NEAR HIGH PRESSURE END SEAL

Figure 1:
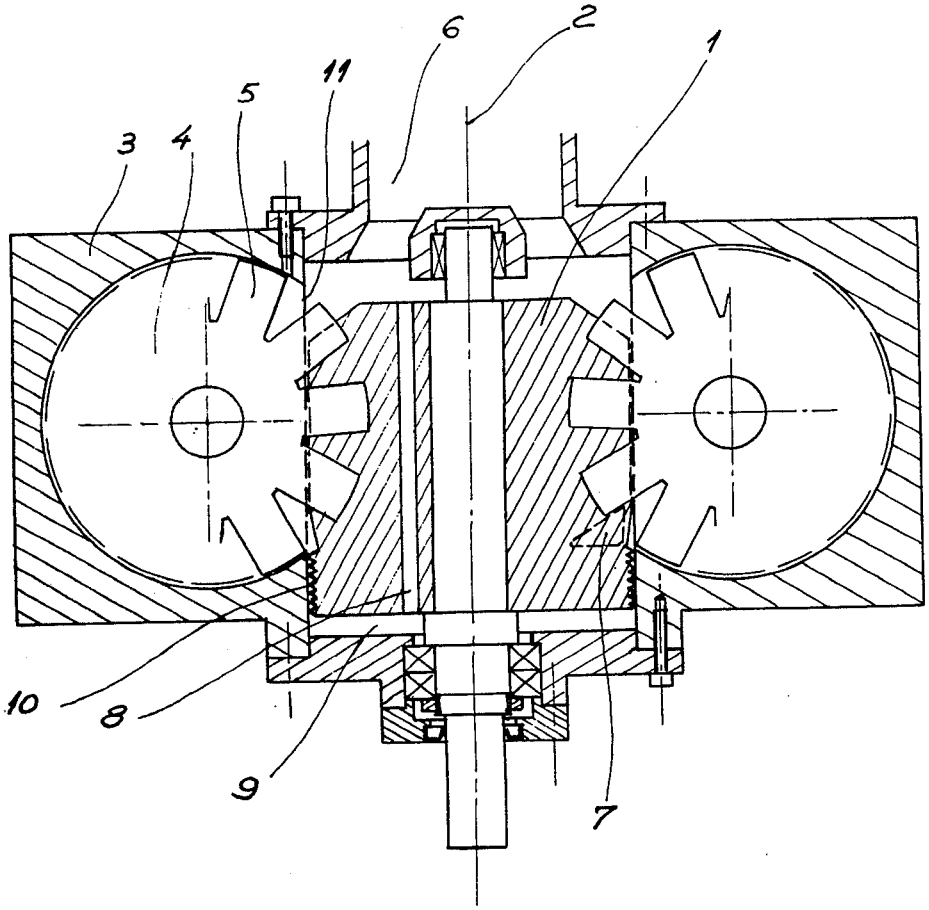

It is known to build single screw compressors comprising one screw rotatably mounted inside a fixed casing and meshing with the teeth of at least one pinion-wheel.

Such compressors have been disclosed especially in French Pat. Nos. 1 331 998 and 1 586 832 or in British Pat. Nos. 1 548 390 and 1 555 329.

The efficiency of these compressors obviously depends on the clearance existing between the various parts. Some of these clearances can be adjustable. Such is the case, for instance, with the clearances existing between the pinion-wheels and the casing in the compressors according to French Pat. No. 1 331 998, and also with the clearance existing between the pinion-wheel and the screw when using cylindrical pinion-wheels with trapezoidal shaped teeth as covered by Patent No. 1 586 832.

In the case of a screw with a cylindrical outer shape such as used in the compressors described in the above mentioned British Patents, the efficiency significantly depends on the clearance between the screw and the casing, and therefore depends on the manufacturing accuracy because, due to the cylindrical profile, said clearance is not adjustable.

This clearance becomes especially critical in single screw compressors used without oil injection, for instance, for the compression of Refrigerant 22 in refrigeration plants. Eliminating the need for oil is extremely desirable for several reasons, notably for reducing the cost by eliminating the oil circuit, and for obtaining an oil-free gas, which has several advantages during travel through the exchangers. However, without oil the efficiency of the compressor becomes very sensitive to the dimension of the clearance between the screw and the casing, because this clearance is no longer sealed with oil as was the case in oil injected compressors. See addition 78.706 to French Pat. No. 1 268 586.

Attempts have been made to reduce this clearance, but as soon as it becomes smaller than a radial play of approximately $5\times10^{-4}$ of the diameter (the exact limit depending on the accuracy of the construction), it has been observed that the compressor becomes liable to seizing between screw and casing. Considering the materials industrially used for this kind of compressor, i.e., cast from iron for the screw as well as for the casing, this seizing is almost always fatal and ruins the machine.

Attempts have been made to solve this problem by forming in the surface of the screw or of the casing honey-comb cells which limit the effects of the seizing and which are described in the French Patent application No. 81 11 906 of June 17, 1981. However, these honey-combs are extremely expensive to produce.

According to the invention, in a volumetric machine, such as a single screw compressor, pump or expansion engine or the like comprising a screw rotatable about an axis within a fixed casing and provided with several threads meshing with the teeth of at least one pinion-wheel, said casing being provided with at least one low pressure port and with at least one high pressure port located close to, said pinion-wheel, said screw being provided at its end adjacent the high pressure port; with a sealing device ensuring an almost perfect leak-tightness between the screw and the casing, the clearance between the screw and the casing increases along a generating line of the casing when moving from the low pressure port to the high pressure port and reaches its maximum adjacent the sealing device.

In a preferred arrangement particularly suitable to the cylindrical screws, the latter are cylindrical on almost their whole outer surface except around their high pressure end where they are conical, with a very small angle vertex, the smallest diameter of said cone being located adjacent the end of the sealing device.

It will be noticed that this device can not only be applied to compressors without oil injection, but also to expansion engines intended to supply mechanical energy from the expansion of compressed gas where it is very difficult to ensure sealing through liquid injection, or to pumps with a very high pressure ratio where the clearance also becomes critical.

Figure 2:
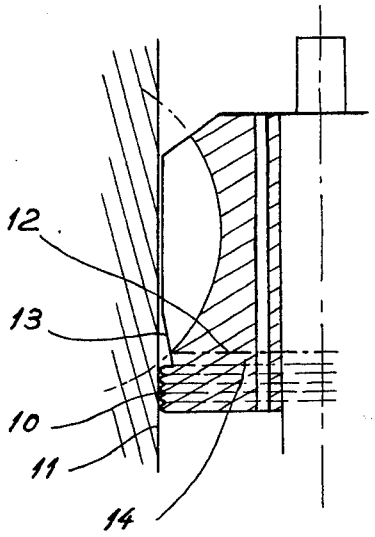
Figure 3:
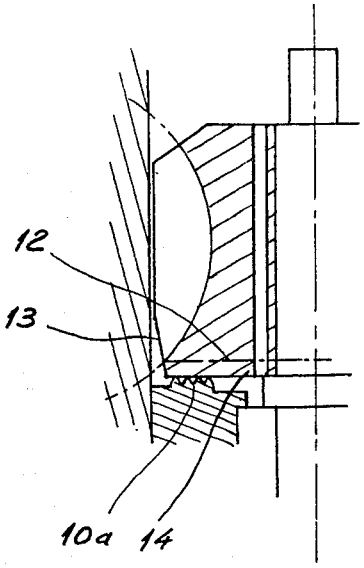
Figure 4:
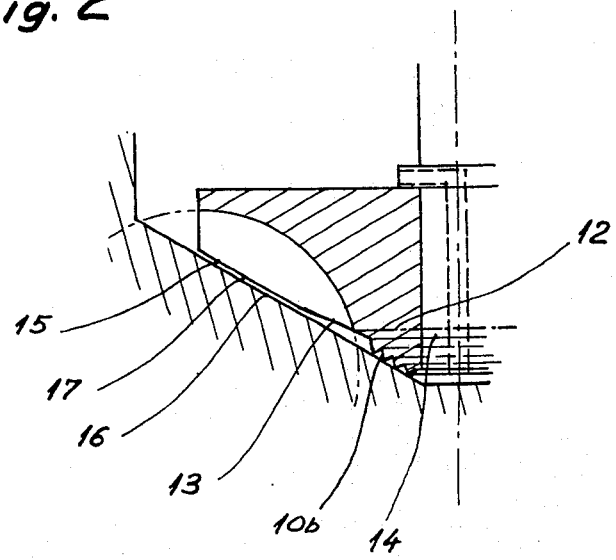

This invention will be better understood by reading the description hereafter and the attached drawings, given by way of nonlimitative examples and in which:

FIG. 1 is a sectional view of a pump, compressor or expansion engine according to the French Pat. No. 1 331 998, and embodying the invention, FIG. 2 is a partial schematic view of the device shown in FIG. 1, FIG. 3 shows the invention in combination with another type of sealing device at the high pressure end of the screw, FIG. 4 shows the invention applied to the case of a conical screw.

With reference to FIG. 1, the machine, such as a pump, a compressor or an expansion engine, comprises a screw 1 mounted for rotation about an axis 2 within a casing 3. The screw 1 meshes with two pinion-wheels such as 4 provided with teeth 5. The casing is provided with a low pressure port 6. The casing is also provided with high pressure ports located close to each pinion-wheel. One such high pressure port is shown at 7, in dotted lines because it is in fact carried by that part of the casing 3 which is removed as a result of the sectional view.

The screw is provided with channels 8 in order to connect with the low pressure a cavity 9 adjacent the end of the screw on the high pressure side, and to balance the thrusts on either side, and thus eliminate any axial thrust.

The screw also comprises, at its high pressure end, an annular sealing device and more precisely a labyrinth 10, of a known type, consisting preferably of a spiral similar to a threading. This threading is produced with a diameter approximately equal to the diameter of the bore of the casing 11. Even if, when assembling, there is a contact between the threading crests and the casing, the crests are quickly abraded by friction and an extremely small clearance is thus obtained, ensuring an almost perfect leak-tightness between the screw and the casing on the high pressure side. It will be appreciated that there is no seizing, in spite of the reduced clearance, because the chips created by the friction of the threading crests against the casing fall into the grooves of the threading and that every chip which starts rolling between the crests of the threads and the casing is quickly stopped, because of the spiral, by the grooves of the thread.

However, such a threading cannot be extended up to the area of the screw which carries the threads of the screw and the grooves of these threads, because it would result in leakages along the grooves of the threading forming the labyrinth.

Therefore, between the end of the threads of the screw—as shown in 12 on FIG. 2—and the threading 10, one usually leaves a smooth and uninterrupted section 14.

As can be seen on FIG. 1, and more clearly on FIG. 2, the screw according to the invention has a maximum clearance in the vicinity of the sealing device. The clearance progressively decreases when moving toward the low pressure port along a generating line of the screw.

In an embodiment which is preferred because it is simple to achieve, the screw is given the shape of a cone 13, extending from the sealing device towards the cylindrical part.

As a numerical example, a compressor using a screw of 140 mm diameter meshing with two symmetrical pinion-wheels of also 140 mm diameter having a swept volume of approximately 2500 liters/min at 3000 rpm, and used to compress Refrigerant 22 from 4 bars to 12 bars and cooled by an injection of the same liquid refrigerant, has an isentropic efficiency of approximately 65% when the screw is cylindrical on its whole length and when the radial screw-casing clearance is approximately 0.1 mm.

With such a clearance, seizing has never been registered.

If the radial clearance is reduced to 25 microns, seizure generally occurs instantaneously.

If, on the other hand, according to the invention, a radial clearance of 25 microns is kept in the vicinity of the high pressure end of the screw, and if, for instance, the cone 13 extends from a circle located at a distance of 15 mm from the end of the threads 12 toward the high pressure end and over a 2 mm wide section 14, and if the radial clearance between screw and casing where the cone 13 connects with the sealing device 10, is 0.1 mm, the isentropic efficiency of the compressor reaches 72%—i.e. a relative increase of 10%—and no seizing occurs. The achieved efficiency enables this machine to compete with the best known piston machines, while a 65% efficiency makes it difficult to use nowadays when energy efficiencies have become essential.

This substantial improvement in efficiency splits up almost equally, from an energy point of view, into an improvement of the volumetric efficiency and a reduction of the shaft power attributable to the reduction of the gas leakage from a thread during compression toward the next thread.

But it is even more remarkable that said increase in efficiency is practically equal to that which would be achieved in using a completely cylindrical screw, i.e. without a cone. In other words, the conical shape does not result in any penalty concerning efficiency.

As a matter of fact, tests have been made using a screw provided on its surface with honeycomb cells allowing radial clearances of 25 microns without any risk of seizure.

A cone having the above cited dimensions was then machined on said screw.

The difference in efficiency is less than 0.5%, the difference in capacity being zero and the increase in shaft power being approximately 0.4%.

A reason for this unexpected result may be that the clearance which results from the cone being machined on the screw is situated where the crests of the threads are the widest, and therefore the corresponding leakage flow remains limited.

FIG. 3 shows an embodiment of sealing device in accordance with the British Pat. No. 1 548 390 which has been modified according to the invention and provides then results similar to what has been stated hereabove. In the embodiment of FIG. 4, the invention is used with a conical screw according, for instance, to French Pat. No. 2 286 958, according to which the screw is made of a conical part 15 which has the same angle as the concave cone 16 of the casing and is mounted with a very small clearance 17. The cone 16 is followed by the cone 13 providing a clearance increasing from cone 15 up to the sealing device **10*b***.

The instant invention, described in the case of compressors with plane pinion wheels, would not be modified if it was applied to compressors with cylindrical pinion wheels in accordance with French Pat. No. 1 586 832, or to pumps, or to expansion machines.

I claim:

1. A volumetric machine, such as a compressor, pump or expansion machine or the like, comprising a screw rotatably mounted about an axis inside a fixed casing and provided with several threads meshing with the teeth of at least one pinion wheel, said casing being provided with at least one low pressure port and at least one high pressure port located close to said pinion-wheel, said screw being provided at its end adjacent the high pressure port, with a sealing device ensuring an almost perfect leak tightness between the screw and the casing wherein the clearance between the screw and the casing increases when moving along a generating line of the casing from the side of the low pressure port towards the side of the high pressure port and reaches its maximum adjacent the sealing device.

2. A compressor, pump or expansion machine according to claim 1 wherein the area of the casing which cooperates with the threads of the screw, is cylindrical and wherein the envelope of the crests of the threads of the screw is a cylinder in the area of the screw which is in contact with the low pressure, prolonged by a cone with a small slope having its smallest diameter adjacent the sealing device.

* * * * *